United States Patent [19]

Leray et al.

[11] Patent Number: 4,471,944

[45] Date of Patent: Sep. 18, 1984

[54] TELESCOPIC JACK

[76] Inventors: Gerard Leray, 13 Chemin des Flammes; Jules Leray, 17 Chemin des Flammes, both of 80300 Albert, France

[21] Appl. No.: 348,047

[22] PCT Filed: Jun. 4, 1981

[86] PCT No.: PCT/FR81/00070

§ 371 Date: Feb. 1, 1982

§ 102(e) Date: Feb. 1, 1982

[87] PCT Pub. No.: WO81/03528

PCT Pub. Date: Dec. 10, 1981

[30] Foreign Application Priority Data

Jun. 5, 1980 [FR] France ..... 80 12494

[51] Int. Cl.[3] ..... B66F 3/24

[52] U.S. Cl. ..... 254/93 R; 92/53; 92/29

[58] Field of Search ..... 92/29, 51, 52, 53, 23; 254/93 R

[56] References Cited

U.S. PATENT DOCUMENTS

| | | | |
|---|---|---|---|
| 3,353,454 | 11/1967 | Donovan | 92/52 X |
| 3,417,670 | 12/1968 | Madland | 92/52 |
| 4,303,005 | 12/1981 | Glomski et al. | 92/53 X |

FOREIGN PATENT DOCUMENTS

| | | | |
|---|---|---|---|
| 956653 | 1/1957 | Fed. Rep. of Germany | 254/93 R |
| 2290613 | 6/1976 | France | 92/53 |
| 281335 | 4/1928 | United Kingdom | 92/53 |

*Primary Examiner*—Frederick R. Schmidt
*Assistant Examiner*—Steven P. Schad
*Attorney, Agent, or Firm*—Finnegan, Henderson, Farabow, Garrett & Dunner

[57] ABSTRACT

A telescoping jack having a cylinder and a plurality of coaxial tubular elements mounted within the cylinder, the elements being movable between a retracted position where they are nested within the cylinder and an advanced position. Each pair of adjacent tubular elements has two pairs of cooperating annular recesses on their inner and outer surfaces which pairs of recesses cooperate, in combination with an elastic ring, to limit the outward movement of an inner tubular element relative to its adjacent outer element.

1 Claim, 10 Drawing Figures

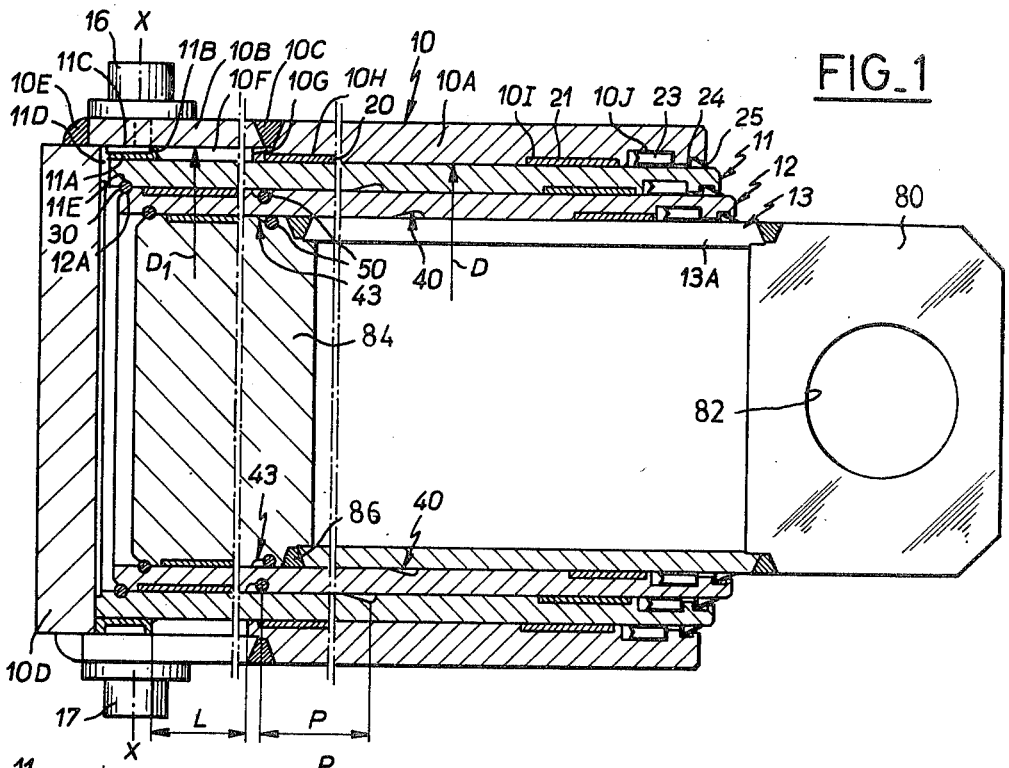
FIG_1
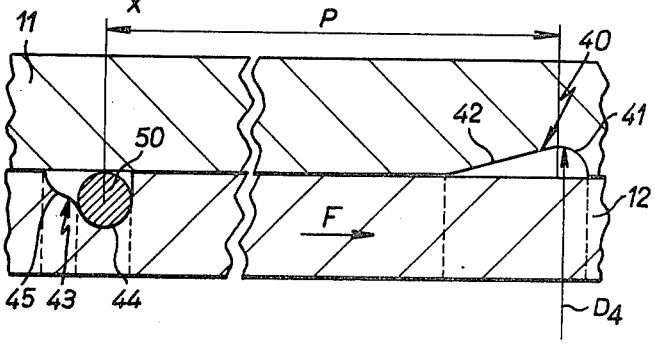
FIG_2
FIG_3
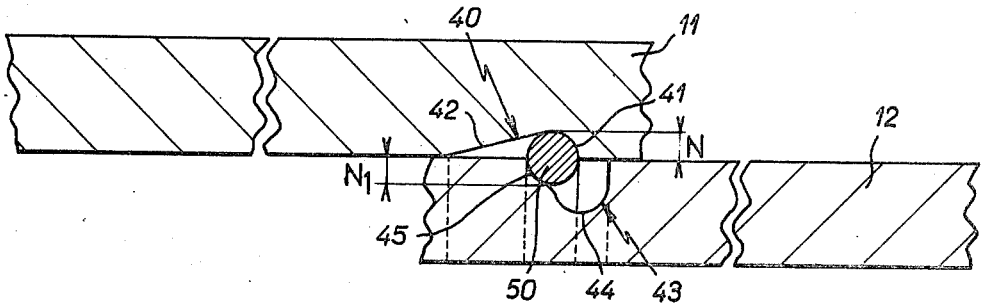

TELESCOPIC JACK

The present invention relates generally to jacks, and more particularly to single-acting telescopic jacks.

It is known that jacks of the type in question comprise a cylinder with a connection to a source of pressurised fluid, and within this cylinder a series of coaxial tubular elements which may occupy a forward position in which they extend the said cylinder, or a position retracted within the cylinder in question.

In practice the above tubular elements comprise front and rear end stroke means such that, under the action of the pressure of the fluid, the tubular element having the greatest reaction surface entrains the other elements in its stroke, followed in a similar way by an adjacent element and so on, until the said tubular elements occupy a forward position extending the said cylinder. From this forward position, the process is carried out in an inverted manner towards the retracted position in which the said elements are housed within the cylinder.

In a manner known per se the front and rear end stroke means mentioned above are in general constituted by catches provided at the ends of the tubular elements. An annular depression is thus formed between these catches and in which a catch of an adjacent element may be displaced, the adjacent element itself comprising an annular throat with two end catches for the movement of another tubular element and so on, the length of the above-mentioned annular depressions defining the stroke of the tubular element which is slidably mounted in the depressions. At present the elements in question are obtained from conventional tubes machined internally and externally over their entire length to form the depressions and consequently the catches. A technique of this type has certain drawbacks.

In the first instance, the machining operations for the tubes are long and complex; they lead furthermore to a non-negligible loss of raw material.

The overall size of telescopic jacks provided with these elements is considerable, in particular as a result of the fact that the depressions provided on the tubular elements for the movement of the catches cause a considerable spacing between the said elements.

In addition, the mechanical resistance properties of commercially available tubes at present used in the construction of the tubular elements require the use of tubes having a thickness suitable for supporting pressures which may arise within the jacks. It can therefore be seen that, in addition to the considerable overall dimensions mentioned above, the jacks are heavy as a result of the structure of the tubes used.

The present invention is designed to resolve the above-mentioned problems relating to weight and overall dimensions, whilst retaining and even substantially improving the mechanical resistance of the jack, using means which have practically no effect on the cost price.

In accordance with a characteristic feature of the invention, this result is obtained by using as the basic material for a telescopic jack and including its cylinder, tubular elements of drawn steel whose properties of mechanical resistance are substantially greater than those of conventional tubes and which do not require any further machining for the sliding portions apart from a slight finishing.

In association with these tubular elements the invention provides front and rear end stroke means designed to enable progressive extension outside of the cylinder or progressive withdrawal within the cylinder of the said elements, the said front end stroke means being characterised in that they are advantageously constituted by at least one discontinuous and elastically deformable ring which is, in a retracted position of the tubular elements, housed in a first depression provided in a first tubular element, thus enabling a minimum clearance to be obtained between this first tubular element and a second adjacent tubular element, whilst in the forward position of the said first tubular element the end stroke means is partly supported in the above-mentioned depression and partly in a second depression provided for this purpose in the said second tubular element.

With respect to the rear end stroke means, these are advantageously, in accordance with a further characteristic feature of the invention, constituted by a retaining ring engaged in a groove provided in the vicinity of the rear end and on the internal surface of a tubular element having a projecting portion therefore constituting a stop for a further tubular element contacting the internal surface of the previous element.

The association of tubular elements of drawn steel and end stroke means as described above enables the achievement of a jack having considerable advantages with respect to jacks of the same type known at present.

The jacks of the present invention are smaller in size as a result of the fact that there is no wasted space between the tubular elements which are slidably mounted with respect to one another without manifest play, i.e. only the play required for operation. They are lighter, as the tubes are not as thick as in the past, and at the same time have mechanical properties which are improved with respect to conventional telescopic jacks. In addition, the machining operations are reduced to an absolute minimum. i.e. a slight degree of finishing and the machining of the depressions required for the front and rear stop means and the various sealing joints. All these structural details taken in combination provide a jack which remedies the drawbacks mentioned above.

Further features and advantages of the invention will be shown in the following description which is given by way of example with reference to the attached drawings, in which:

FIG. 1 is an axial section through an embodiment of a telescopic jack according to the invention, the tubular elements constituting this jack being in a retracted position;

FIG. 2 is a part view, on an enlarged scale, of an embodiment of the front end stroke means disposed between two adjacent elements;

FIG. 3 is a view showing a front end stroke means in an active position;

Figure 4:
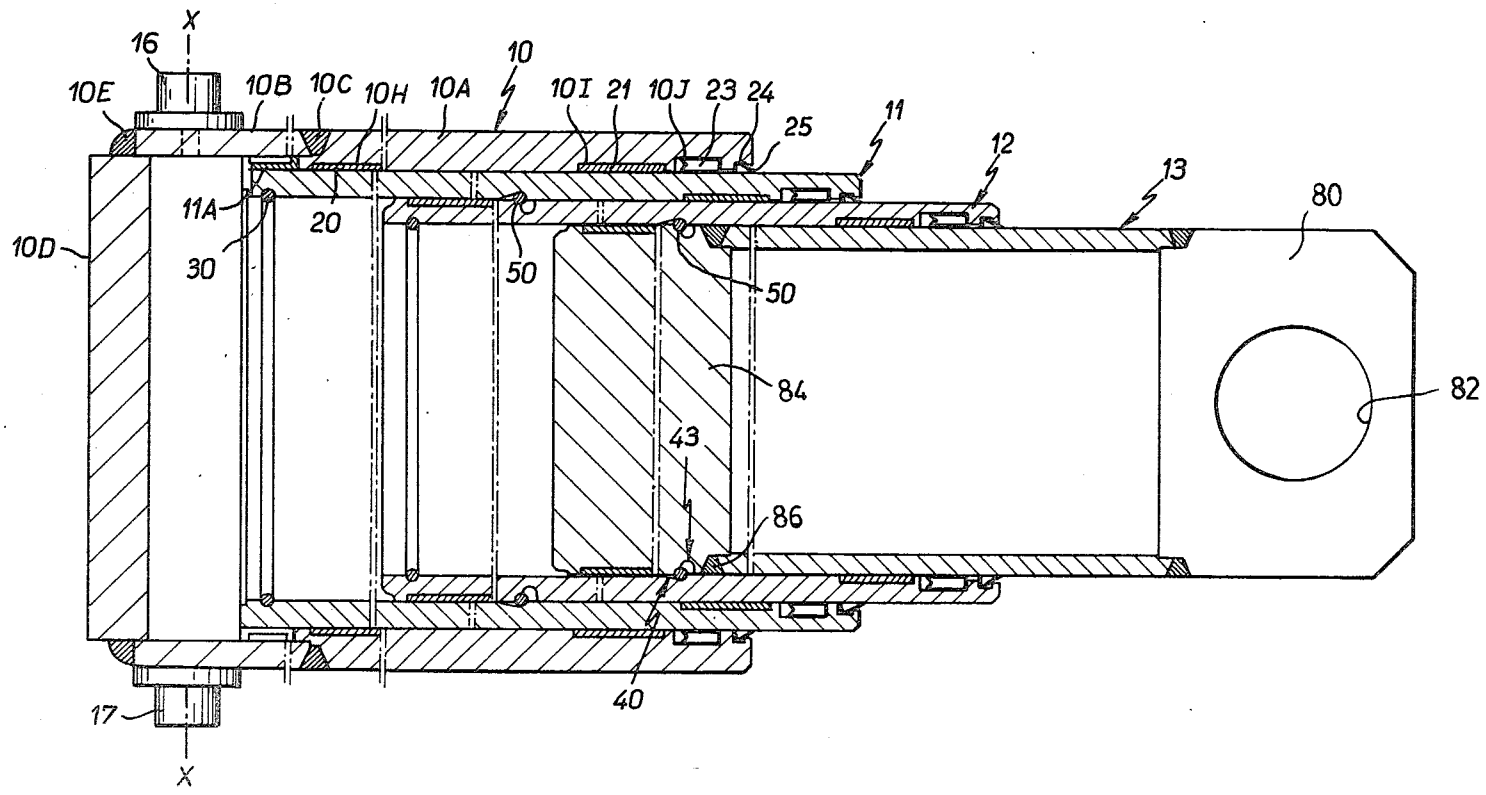
FIG. 4 shows the jack according to FIG. 1 with its tubular elements in the front end stroke position.

In the selected embodiment shown in FIGS. 1 to 7, a jack of the type having telescopic elements comprises a cylinder 10 and a certain number of tubular elements, for example three, respectively 11, 12 and 13 in the example shown.

The cylinder 10 is itself constituted by two tubular sections 10A, 10B assembled by welding 10C, whereas a base 10D connected by welding 10E to the free end of the tubular section 10B closes a rear end of the cylinder.

The tubular section 10B in addition comprises two diametrally opposite trunnions 16, 17 designed to enable the fastening of the jack to any support on which it may pivot about an axis X—X, at least one of the trunnions being further provided so as to be connected in a known manner to a pressurised fluid source (not shown).

The section 10A of the cylinder 10 has an internal diameter D which is smaller than the internal diameter D1 of the section 10B such that an annular space 10F is provided between the internal surface of the section 10B and the tubular element 11.

The above-mentioned space is limited on one hand by a circular shoulder 10G formed by the difference in the diameters D and D1 and, on the other hand, by the front face 11B of an annular component 11A connected by welding to the rear end of the tubular element 11, wherein the annular component may be displaced in the space 10F. The said shoulder 10G and the base 10D thus form front and rear end stroke stops respectively for the first tubular element 11.

At certain points of its periphery the annular component 11A comprises ducts 11C, 11D enabling the admission of the pressurised fluid onto the reaction surfaces of the elements 11, 12 and 13 respectively.

In the immediate vicinity of the end stroke stop 10G, the section 10A of the cylinder 10 comprises an annular housing 10H in which there is disposed a flat ring 20, for example of plastics, performing a guiding function for the second tubular element 11.

As its end opposite to the axis of articulation X—X the section 10A of the cylinder 10 is provided internally with an annular housing 10I for a ring 21 similar to the above ring 20, and with a housing 10J for a sealing joint 23 and a release 24 for a further lipped sealing joint 25.

The first tubular elment 11 is coaxial with the cylinder section 10A a slight play, required for operation, being provided between the cylinder and the first tubular element, which may therefore be axially displaced between the end stroke stops 10G and 10D mentioned above.

It will be noted that the distance between a front face 11B of the annular component 11A and the shoulder 10G forming the stop at the front determines the length L of the stroke of the tubular element 11.

The axial displacements of the tubular elements 12 and 13 are limited by the end stroke stops both in the retracted position of the elements (rear end stroke stop) and in the forward position (front end stroke stops).

The rear end stroke stop of the tubular element 12 is constituted by an annular groove 11E provided on the internal face of the tubular element 11 in which there is engaged a retaining ring 30 designed to engage with a circular impression 12A provided at the rear end of the tubular element 12. The above-mentioned retaining ring 30 has a projecting portion thus constituting a rear end stroke stop for the tubular element 12, whilst a front end stroke stop for this tubular element 12 is formed by a device which will now be described with particular reference to FIGS. 2 and 3.

As can be seen from these Figures, the tubular element 11 comprises, on its internal wall, a first circular depression designated overall by 40 and having in cross-section an overall oblique shape, comprising a notch shaped as the quadrant of a circle 41 which is extended towards the rear by a substantially flat section forming a ramp 42. With respect to the tubular element 12 which is spaced from the previous element by a slight play as described above, this comprises on its external surface a second depression of a stepped type designated overall by 43 comprising in cross section a first and a second stage formed by a substantially semi-circular groove 44 extended towards the rear by a groove 45 substantially shaped as a quadrant of a circle.

The end stroke stop device at the front is completed by a ring 50 housed in a groove 44 and discontinuous and elastically deformable whose diameter is, in the slack state, substantially equal to the diameter D4 of the base of the first depression 40.

In the position of the elements shown in FIG. 2, the ring 50 is therefore compressed by the tubular element 11.

It should be noted that between the respective tubular elments 12 and 13 there are provided front and rear end stroke stop means similar to those described above.

When the tubular elements 11, 12 and 13 are in the rear end stroke position, as shown in FIG. 1, the tubular element 11 abuts against the base 10D, whilst the tubular elements 12, 13 are supported at their respective rear ends by retaining rings 30. The front end stroke devices are simultaneously inoperative as a result of the fact that the retaining rings are compressed by the elements 11 and 12 and are housed in the groove 44 of the second depression 43.

When the pressure of the fluid is contacted with the reaction surfaces of the tubular elements 11, 12, 13 and after the tubular element 11 has performed its axial stroke L whilst entraining the other tubular elements 12, 13, i.e. until it is in contact with the front end stroke stop 10G, the tubular element 12 is axially displaced from its rear end stroke position to a front end stroke position.

At the beginning of the axial displacement (arrow F, FIG. 2) of the tubular element 12, the ring 50 slides on the internal wall of the tubular element 11 until it reaches (FIG. 3) a point opposite the first depression 40 where it slackens and gradually penetrates therein under the combined effect of its elasticity and the ramp 42.

It should be noted that the ring 50 in its operating position, i.e. the position corresponding to FIG. 3, is supported over part of its periphery of the quadrant shaped notch 40 and is partly supported on the groove 45 forming the second stage 45 of the depression 43, the areas of support being substantially diametrally opposite, as a result of the fact that the depths N, N1 of the notch 41 and of the second stage 45 are substantially equal to half the thickness of the ring 50, at this time the tubular element 12 is axially locked in the front end stroke position as a result of the fact that the tubular element 11 is itself axially locked.

The same applies to the tubular element 13 which, in the example illustrated, comprises at its front end an iron connection piece 80 having a passage 82 for fastening to any element, for example a vehicle tip or the like, which is pivotably mounted, whilst at its rear end it is closed by a base 84 connected by welding 86 to a tubular section 13A.

When all the tubular elements 11, 12, 13 have been brought into the front end stroke position, the jack is then in the position illustrated in FIG. 4.

From the above it can be seen that the stroke of the tubular elements 11, 12, 13 is determined by the front and rear end stroke stops. In the case of the tubular element 11 the axial stroke is equal to the length L (FIG. 1) between the front edge 11B of the annular component 11A and the circular shoulder 10G. In the case of the tubular element 12 the axial stroke is equal to the pitch P of the depressions 40, 43 and the same applies to the element 13.

The method for moving the tubular elements 11, 12, 13 from the front end stroke position (FIG. 4) to a rear end stroke position is as follows.

The tubular element 13 is displaced towards the rear alone, and retracts towards the rear from the outset of its displacement the ring 50 as shown in FIGS. 5 to 8.

Figure 5:
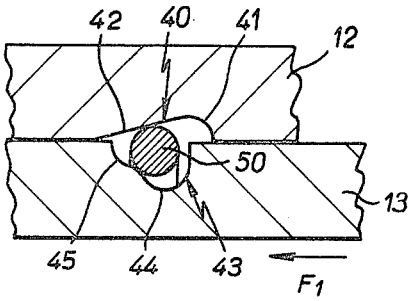
FIGS. 5 to 8 show, partly diagrammatically, the operation of the front end stroke means when a tubular element is displaced from a forward position to a retracted position.
Figure 6:
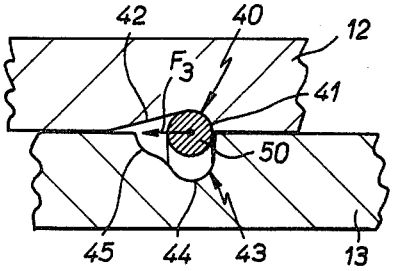
Figure 7:
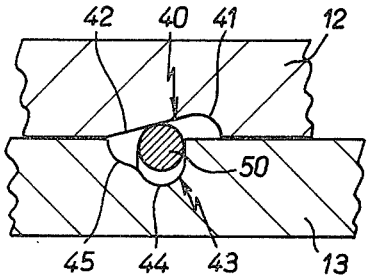
Figure 8:
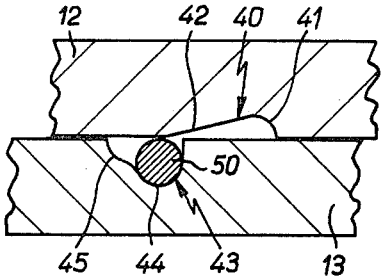

In FIG. 5 the tubular element 13 has commenced its rearward movement (arrow F1), as a result of the fact that the pressure of the fluid in the jack has been gradually released, and continues until the edge of the end of the first stage 44 comes into contact with the ring 50 (FIG. 6). The axial rearward displacement of the tubular element 13 continues and the ring 50 is entrained towards the rear (arrow F3) whilst being progressively compressed under the action of the ramp 42, (FIG 7) until, having been freed from the said ramp it is completely engaged in the first stage 44 (FIG. 8). The tubular element 13 then continues its axial stroke until it abuts against the retaining ring 30 supported by tubular element 12, in which position the said tubular element 13 is retracted and in its rear end stroke position.

The tubular element 12 is then entrained from its front end stroke position to its retracted rear end stroke position in a similar manner to that described above with respect to the tubular element 13.

The same applies to the tubular element 11, with the exception that its rear end stroke position is determined by the annular component 11A contacting the base 10D.

It should be noted that in an embodiment of this type the tubular elements are accurately guided by guide rings 20 and also as a result of the fact that there is a slight clearance between the elements.

Figure 9:
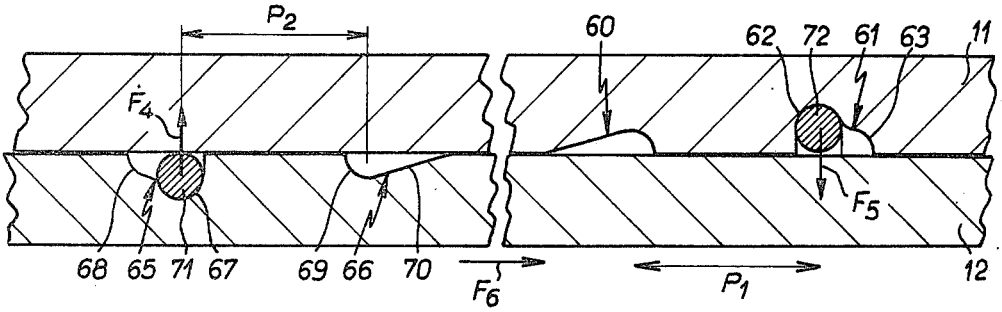
FIGS. 9 and 10 show a variant of the front end stroke means.
Figure 10:
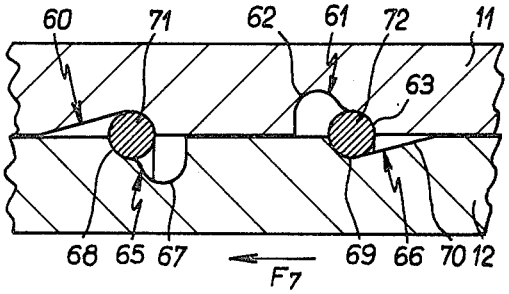

In FIGS. 9 and 10 which show a variant of the front end stroke device, this variant is designed to enable operation with greater pressures and, moreover, to increase the load capacities of jacks equipped in this way.

It is noted that the use of a resilient ring 50 as the front end stroke means of tubular element provides mechanical properties of resistance as a function of dimensions. As it is not possible to impair the resistance of tubular elements by providing deeper throats for end stroke rings which are more consecutive, the invention provides for these tubular elements to be provided with two front end stroke means.

The above-mentioned FIGS. 9 and 10 show part of two tubular elements such as for example the tubular elements 11 and 12 described above, and it can be seen that the tubular element 11 comprises on its internal surface a pair of depressions indicated overall by 60 and 61, the depression 60 which is oblique overall having a cross-section similar to the depression 40 described above, whilst the stepped depression 61 has a cross-section similar to that depression 43 described above, the deeper stage being located at the rear and extended forwardly by a second stage 63 whose depth is substantially half that of stage 62.

The depressions 60, 61 are spaced by a pitch P1.

The tubular element 12 comprises on its external surface a pair of depressions indicated overall by 65, 66, the depression 65 located at the rear comprising two stages 67, 68 similar to the depression 43 of FIG. 2, and the depression 66 located at the front comprising a groove 69 shaped substantially as a quadrant of a circle followed towards the front by a ramp 70 which is substantially plane and communicates with the external surface of the element 12.

The pitch P2 of the depressions 65, 66 is similar to the pitch P1 of the depressions 60, 61.

It should be noted that in all the Figures, the rear is on the left-hand side and the front on the right-hand side of the drawings.

In accordance with this variant, and when the elements are in the retracted rear end stroke position (FIG. 9), the depression 65, and more particularly the stage 67, house a discontinuous and elastically deformable ring 71 which is compressed when the elements 11 and 12 are in the rear end stroke position, whilst the depression 61 and more particularly the stage 62 house a ring 72 which is caused to expand when the said elements are in the above position.

The ring 71 therefore tends to spread out radially along the arrow F4 whereas the ring 72 tends to close radially over itself along the arrow F5.

When the elements 11 and 12 are in the front end stroke position after a displacement along the arrow F6 of the tubular element 12 (FIG. 10) a double front end stroke stop is obtained as a result of the fact that the ring 71 is partly supported in the depression 60 and partly in the depression 65, whilst the ring 72 is partly supported in the depression 61 and partly in the depression 66.

From this front end stroke position to a rear end stroke position, the tubular element 12 being displaced towards the rear (arrow F7) whilst the tubular element 11 is immobile, the rings 71, 72 respectively reintegrate the stages 62 and 67, the first, in this case the ring 72, being repositioned in the tensioning position under the action of the ramp of the depression 66 and the other, 71, being in contrast repositioned in the compressed position in the depression 65 under the action of the ramp provided in the depression 60.

It will be understood that an arrangement of this type enables the overall force of the jack to be doubled, bearing in mind that the tubular elements are calculated as a function of this arrangement.

The invention is not, however, limited to the embodiments selected and illustrated which may be modified without departing from the scope of the invention.

Thus, in the examples illustrated, the front end stroke rings, i.e. the rings 50, 71, 72 having a circular cross-section may be designed with a different cross-section, for example quadrangular or oval, with depressions designed to receive these rings.

In addition, it should be noted that the tubular elements 11, 12, 13 have decreasing thicknesses, as can be seen from the drawings, and that the same applies to the rings 50, 71, 72 which themselves have sections which decrease with the diameter of the tubular elements.

We claim:

1. A telescoping jack comprising: an outer cylinder having an open end and a closed end; a set of at least two telescoping tubular elements coaxially mounted within the cylinder for sliding movement relative to said cylinder and with each other, the innermost element having a base directed toward the closed end of the cylinder, the outermost element being movable between a retracted position and an advanced position relative to the cylinder and every other element being movable between a retracted position and an advanced postion relative to its adjacent external element; means for introducing hydraulic fluid into the cylinder for producing a force, in response to pressure applied to the hydraulic fluid, toward the base of the innermost element to extend all of the elements of the jack; rear stop means between adjacent elements to limit displacement of the inner of the two elements to its retracted position; and fore stop means between adjacent elements to limit displacement of the inner of the two elements to its advanced position, said fore stop means comprising at least two pairs of axially spaced cooperating annular recesses, one recess of each pair being located on the outer surface on the inner of the two elements and the other recess being located on the inner surface of the adjacent external element, said recesses of each pair being located opposite each other when the inner element of adjacent elements is in its advanced position and displaced axially from one another when it is in its retracted position, a first recess of each pair having an inclined plane surface extending inwardly from the surface of the element and terminating in a notch, substantially in the shape of a quarter circle, and the second recess of the pair comprising a stepped notch having a first stage, substantially in the shape of a quarter circle and a second contiguous deeper stage, the depth of said deeper stage being substantially equal to the depth of the first stage plus the depth of the notch of the first recess, the notch of the first recess and the deeper stage of the second recess being on the same side axially of each pair of recesses, and a circular ring of elastic material located within the deeper stage of the second annular recess of each pair when the inner element is in its retracted position, said ring having a cross-sectional diameter substantially equal to the depth of the deeper stage and being forced out of the deeper stage and into the space between the notch of the first recess and first stage of the second recess when the pairs of recesses are brought opposite one another to thereby limit outward movement of the inner element to its advanced position, the first recess of at least one pair being located on the outer surface of the inner element and the first recess of at least one other pair being located on the inner surface of the adjacent external element whereby the ring is subjected to compression and expansion respectively, upon operation of the fore stop means.

* * * * *